United States Patent [19]

Bonfiglioli

[11] 3,967,433

[45] July 6, 1976

[54] PROCESS AND MACHINE FOR WRAPPING AND PACKAGING ITEMS IN STRETCHABLE FOIL MATERIAL

[76] Inventor: Sergio Bonfiglioli, Via Emilia Ponente 14, Bologna, Italy

[22] Filed: Sept. 19, 1974

[21] Appl. No.: 507,424

[30] Foreign Application Priority Data

Oct. 5, 1973 Italy ..... 29819/73

[52] U.S. Cl. ..... 53/30 R; 53/32; 53/141; 53/184 R; 53/228; 93/54.2

[51] Int. Cl.[2] ..... B65B 11/16

[58] Field of Search ..... 53/30 R, 32, 33, 34, 53/141, 184 R, 221, 226, 228, 229; 93/54.2, 54.3

[56] References Cited

UNITED STATES PATENTS

| | | | |
|---|---|---|---|
| 2,301,106 | 11/1942 | Brown | 53/141 X |
| 2,423,294 | 7/1947 | Colesworthy | 53/30 X |
| 2,554,636 | 5/1951 | Pfeiffer | 53/30 |
| 2,615,200 | 10/1952 | Cloud | 53/184 |
| 2,914,893 | 12/1959 | Berst | 53/30 S |
| 3,015,916 | 1/1962 | Denton | 53/184 |
| 3,339,339 | 9/1967 | Hull | 53/223 |
| 3,370,394 | 2/1968 | Taylor | 53/33 |
| 3,600,875 | 8/1971 | Boub | 53/230 X |
| 3,662,513 | 5/1972 | Fabbri | 53/34 X |
| 3,750,364 | 8/1973 | Miura | 53/30 |

*Primary Examiner*—Travis S. McGehee
*Assistant Examiner*—John Sipos
*Attorney, Agent, or Firm*—Rose & Edell

[57] ABSTRACT

A process and a machine for packaging items in stretchable foils of plastic material, wherein the foil is subjected to maximum stretching in at least a transversal direction, before bringing the item to be packaged into contact with the thus pre-stretched foil. To avoid further stretching of the pre-stretched foil, the machine comprises a lifting table for vertically elevating the item relative to the pre-stretched foil, and means for controllably releasing at least the transversal opposed foil side edges as the lifting table moves upwardly, while folding the side edges under the item.

7 Claims, 5 Drawing Figures

PROCESS AND MACHINE FOR WRAPPING AND PACKAGING ITEMS IN STRETCHABLE FOIL MATERIAL

BACKGROUND OF THE INVENTION

1. Field of the Invention

This invention relates to a process and a machine for the wrapping and packaging of items in stretchable foils of soft plastic material.

2. Description of the Prior Art

It is known that the sale of many products of wide consumption is made markedly easier by suitably displaying and exhibiting the products themselves. On the other hand the manufacturers and retailers, both for the transportation and storage of the products and because of hygienic reasons, are compelled for the packaging of the articles before displaying and selling them.

With a view to reconciling the requirement of displaying the articles and the need to package them, it has been found useful, particularly in the foodstuff field, to provide a light package substantially consisting of a tray, box or similar container, made of cardboard, foamed polystyrene and the like, containing the goods to be packaged wrapped in a stretchable foil made of soft plastic material (such as modified polyvinylchloride), commonly known as "stretch film."

These foils show themselves particlarly useful for packaging foodstuff goods, even when such goods are liable to deteriorate, because they are air-permeable and chemically stable. It should however be noted that the foregoing stretchable foils also possess peculiar electrostatic characteristics which make them liable to rapid wear, do not present the least flexural strength, tend to get creased, thus taking up an unsightly aspect, and their resistance is markedly impaired by the tensile stresses to which they might have been subjected.

It can therefore be understood that the use of stretchable foils (whose thickness is generally 0.010 to 0.030 mm) for wrapping articles placed in containers or trays, involves several problems, whose solution is made more difficult by the ever increasing automation requirements.

In the prior art there are known various machines which are so devised as to carry out the packaging in stretchable foils of items, particularly of foodstuff goods, placed on carrying trays.

However, such machines carry out the wrapping of items in the stretchable foil without the foil being subjected to a previous complete stretching step. In fact, according to these prior art processes and machines, the stretching of the foil is brought about or completed upon and subsequently the foil being brought into contact with the items to be packaged. So far, for instance, in the U.S. Pat. No. 3,662,513 there is disclosed a process for the packaging of items, wherein a severed foil sheet of stretchable plastic material is placed under simple tension below a folding plate having a passage opening therethrough for the item to be packaged. The item is then raised vertically through the opening, while simultaneously holding fast at least two opposed edges of the foil sheet, which is thereby stretched while being drawn over the item to be packaged. Also according to the packing method disclosed in the Dutch patent application No. 7006535, published on Nov. 8, 1971, wherein the stretchable foil is subjected to stretch up to 20 percent in at least one direction prior to packing, the foil is caused to be further stretched subsequent to contact with the item to be packaged.

Consequently the stretchable foil is subjected, as a consequence of likely uneven contact with the item to be packaged, to differentiated stress, particularly when the items present, as a whole, an irregular upper surface, as in case of wrapping a number of fruits, such as apples, pears and the like, in a container.

These stresses bring about mechanical and electrical anisotropies, which are such as to likely cause the tearing and rapid wear of the foil that, in any case, wraps the goods in an uneven way. Besides, the machines of the prior art are extremely complex and consequently poorly reliable because of the various machine controls which are necessary with a view to making flexible the adjustment of the foil wrapping devices to the various dimensions of the goods and trays. Still another drawback presented by the known processes and machines is that stresses are brought about at peripheral zones of the foil during the stretching step thereof.

Lastly, a remarkable disadvantage presented by the known machines deals with the defective utilization of the stretchable foil which, still as a consequence of not being suitably pre-stretched, is consumed in amounts far larger than it would be required.

SUMMARY OF THE INVENTION

It is therefore an object of this invention to provide a process and a machine for packaging items in stretchable foils, which do not present the foregoing drawbacks.

More particularly, the process and machine of this invention for packaging items in foils of stretchable plastic material, are aimed at performing the wrapping and packaging of the items, after a suitable pre-stretching step of said foil, whereby this latter is used up completely, does not present differentiated shrinkages and localized alterations and is not liable to yieldings, wrinkles and tearings.

The process in accordance with this invention for the wrapping and packaging of items in foils of stretchable plastic material comprises the steps of:

a. unreeling a portion of a continous foil web from a storage roll under an evenly distributed tensile stress, to an unreeled position;
b. subjecting a portion of said foil web to maximum stretching at least at the side edges transversally opposed with respect to the unreeling direction of said foil web;
c. longitudinally holding fast the transversally stretched portion of the foil web, while severing a foil sheet therefrom;
d. vertically elevating the item to be packaged, thereby bringing the item into contact with said stretched foil sheet, while simultaneously releasing at least said transversally opposed foil side edges and folding said side edges under the item to be packaged;
e. folding the leading edge of said foil sheet under the item to be packaged;
f. folding the trailing edge of said foil sheet under the item to be packaged; and
g. welding said edges to the external base of said item.

It should be clearly understood that, within the scope of this invention, by "maximum stretching" it is not meant the ultimate stretch at which the foil can be subjected without exceeding the foil tensile strength, but a pre-fixed stretch value lower than said ultimate stretch, which is reached during the foregoing stretching step (b), and never exceeded in any of the subsequent steps of the packaging process, particularly after the item to be packaged has been brought into contact with the pre-stretched foil.

It has been found that results particularly advantageous are achieved when the pre-fixed maximum stretching, at which the foil is subjected, is comprised between about 22 and 30 percent of the foil initial dimensions.

Whilst it is essential that the foil be subjected to maximum stretching transversally with respect to the foil unreeling direction, it has been found preferable that the foil be also subjected to said maximum stretching longitudinally with respect to the foil unreeling direction.

DESCRIPTION OF PREFERRED EMBODIMENTS

Figure 1:
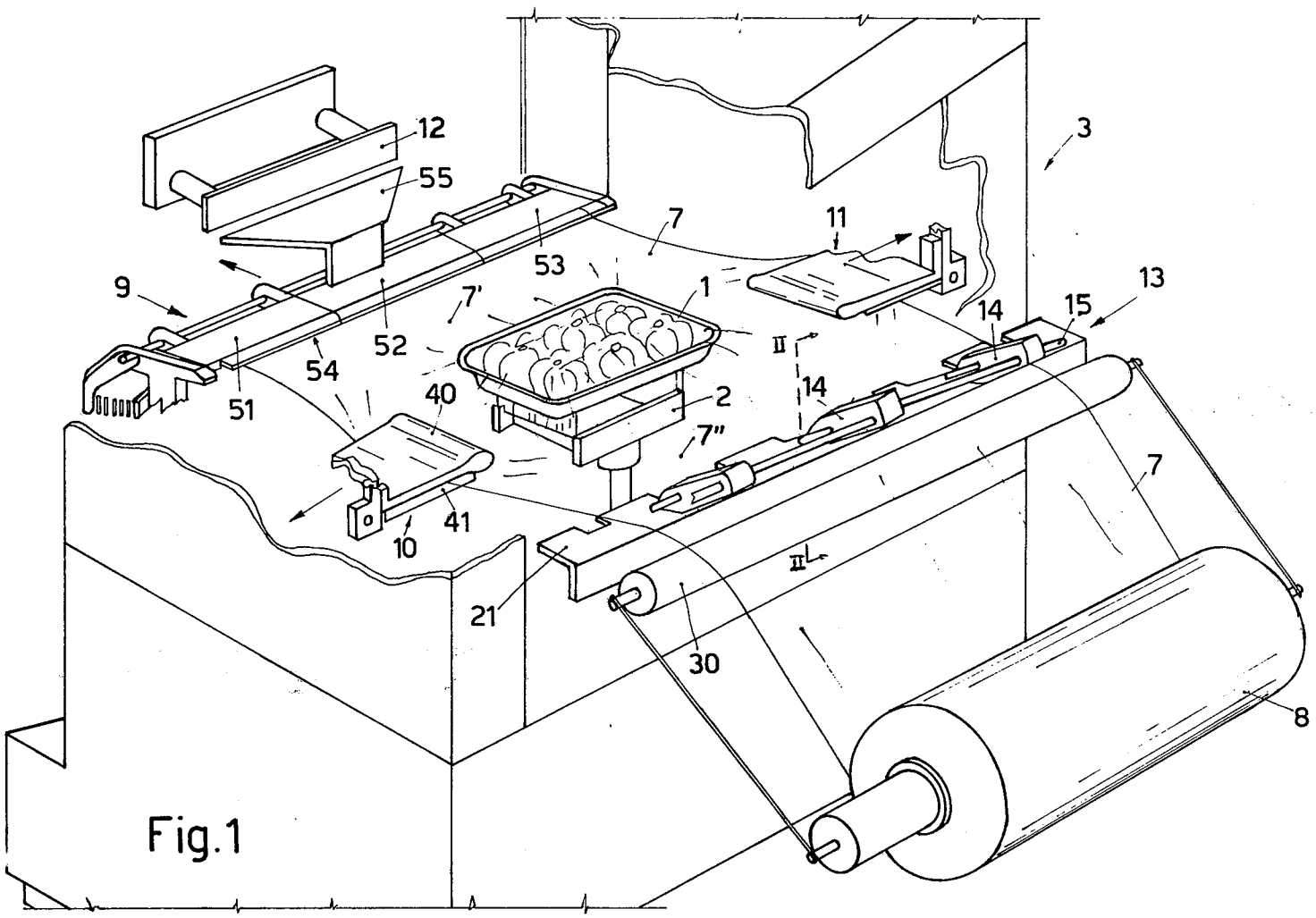
FIG. 1 is a perspective view of a packaging machine according to this invention.

With reference to FIG. 1, the packaging machine of this invention comprises a pedestal frame 3, a lifting table or stage 2 on which there is an item to be packaged, typically a tray 1, having one or more objects placed therein, a storage roll 8, from which a continous foil web 7 made of stretchable plastic material can be reeled off, an unreeling clamp 9, a pair of side clamps 10 and 11, a locking and thrust element 12, and a foil gripping and severing device 13.

Figure 2:
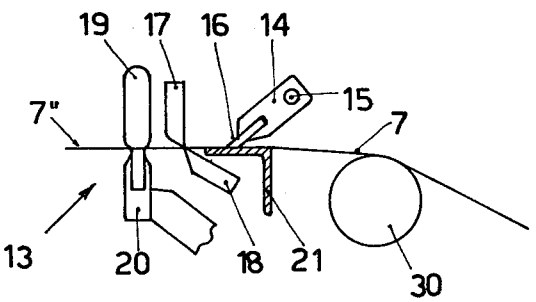
FIG. 2 is a cross-sectional view taken along line II—II of FIG. 1 of the foil gripping and severing devices.

The device 13, whose cross-sectional view is shown in detail in FIG. 2, comprises a sliding element 21 above which there is a shaft 15, bearing a plurality of unidirectional blocks 14, a couple of cutting blades 17 and 18 (not shown in FIG. 1) and a plurality of clamping elements, or brakes, each consisting of an upper clamp 19 and a lower clamp 20, which are also not shown in FIG. 1 for sake of simplicity. Side clamps 10 and 11 consist of a fixed upper element 40 hinged to a movable lower element 41, so as to form an elastic hinge junction. Such hinge elements 40,41 are fitted at their adjoining surfaces with wide plates of elastomeric material, e.g., rubber. Making still reference to FIG. 1, it can be noted that unreeling clamp 9, according to the embodiment shown, comprises three basic clamps consisting of a single lower element 54 and three upper retention elements 51,52,53, elastically hinged thereto.

The machine of this invention also comprises a tray feeding device, which is not shown and disclosed in detail, since it can be realized by means of conventional mechanisms, such as a conveyor belt acting as a feeding platform for a number of suitably spaced apart trays 1.

On the basis of the foregoing disclosures, it is easy to understand the working of the machine according to this invention. Namely, after a tray 1 has been fed onto the lifting table 2 (which is initially in a position lower than that shown in FIG. 1) the unreeling clamp 9 moves forwardly toward and stops short of the sliding element 21, on which the leading edge 7' of the stretchable foil web 7 is held by the unidirectional locking action exerted by elements 14, each of them being fitted with a rubber tongue 16. In this initial step of the wrapping cycle, clamp 9 is allowed to approach element 21, as a consequence of the initial open position of blades 17,18 and clamping elements 19,20. Unreeling clamp 9, after having being brought into contact with foil web 7, grips the leading edge 7' of the foil by opening and closing upwardly by means of the elastic joint of lower element 54.

Following the gripping of stretchable foil 7, clamp 9 moves backwards (this movement being referred to hereafter as the unreeling stroke of clamp 9) until it reaches the position shown in FIG. 1; consequently foil web 7 is reeled off storage roll 8. At this moment, side clamps 10,11 gripping the side opposed edges of foil web 7 between the rubber plates with which they are fitted, move in opposite direction from each other (this movement being referred to herebelow as the forward stroke of clamps 10,11), as shown by the arrows in FIG. 1, thus causing the transversal stretching of foil web 7. According to a preferred embodiment, the forward stroke of clamps 10,11 is such as to cause a stretching of foil web 7, comprised between 22 and 30 percent of foil width. While the foregoing foil transversal stretching step is in progress, the clamping devices consisting of elements 19,20 close, thus restraining foil web 7, whilst blades 17 and 18 (FIG. 2) sever a foil sheet therefrom. At this moment lifting table 2 starts to move upwardly toward the severed foil sheet, which is being held fast at its side opposed edges by clamps 10,11, at its leading edge 7' by clamp 9 and at its trailing edge 7'' by the plurality of clamps 19,20 until lifting table 2 reaches a markedly higher position than that of the surface determined by the initial position of the pre-stretched foil 7.

Figure 3:
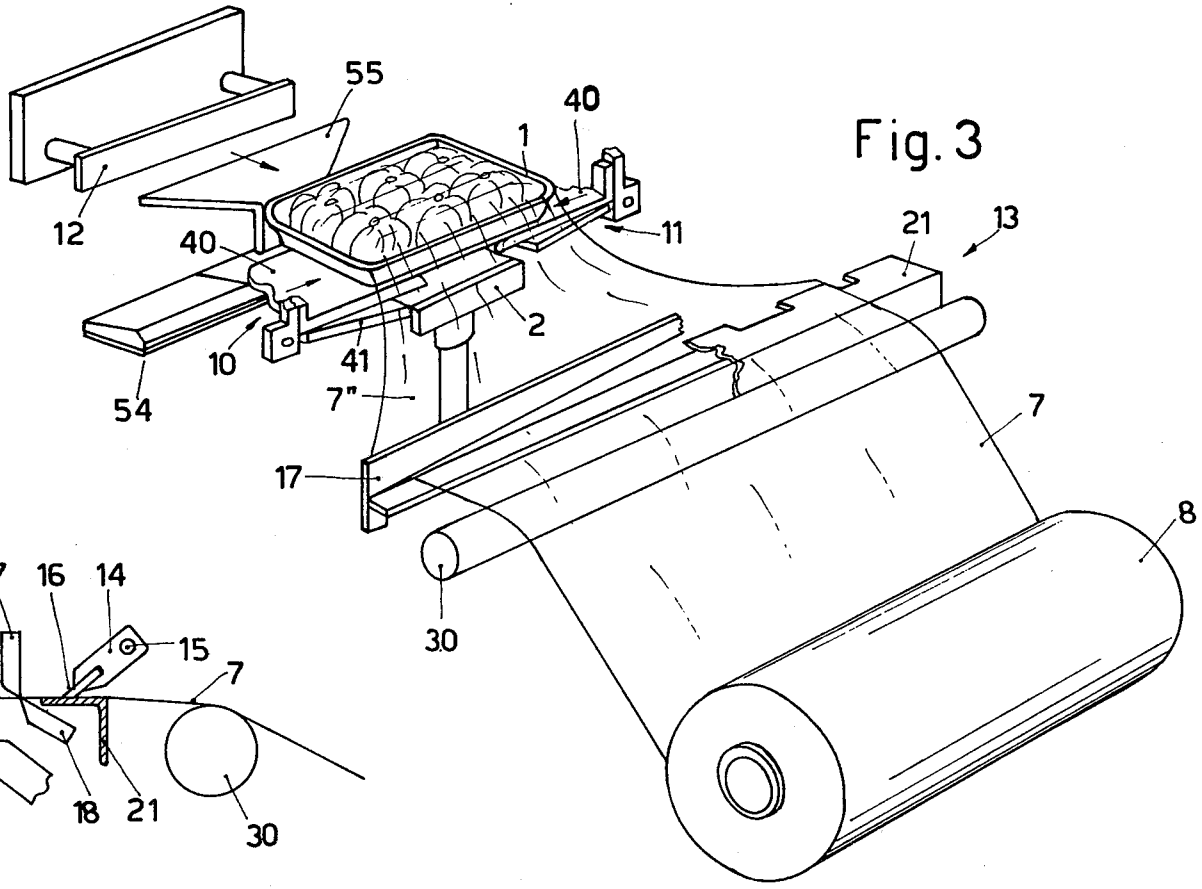
FIG. 3 is a diagram perspective view of the machine of FIG. 1, at an operating stage of its working cycle, subsequent to the stage shown in FIG. 2.
Figure 4:
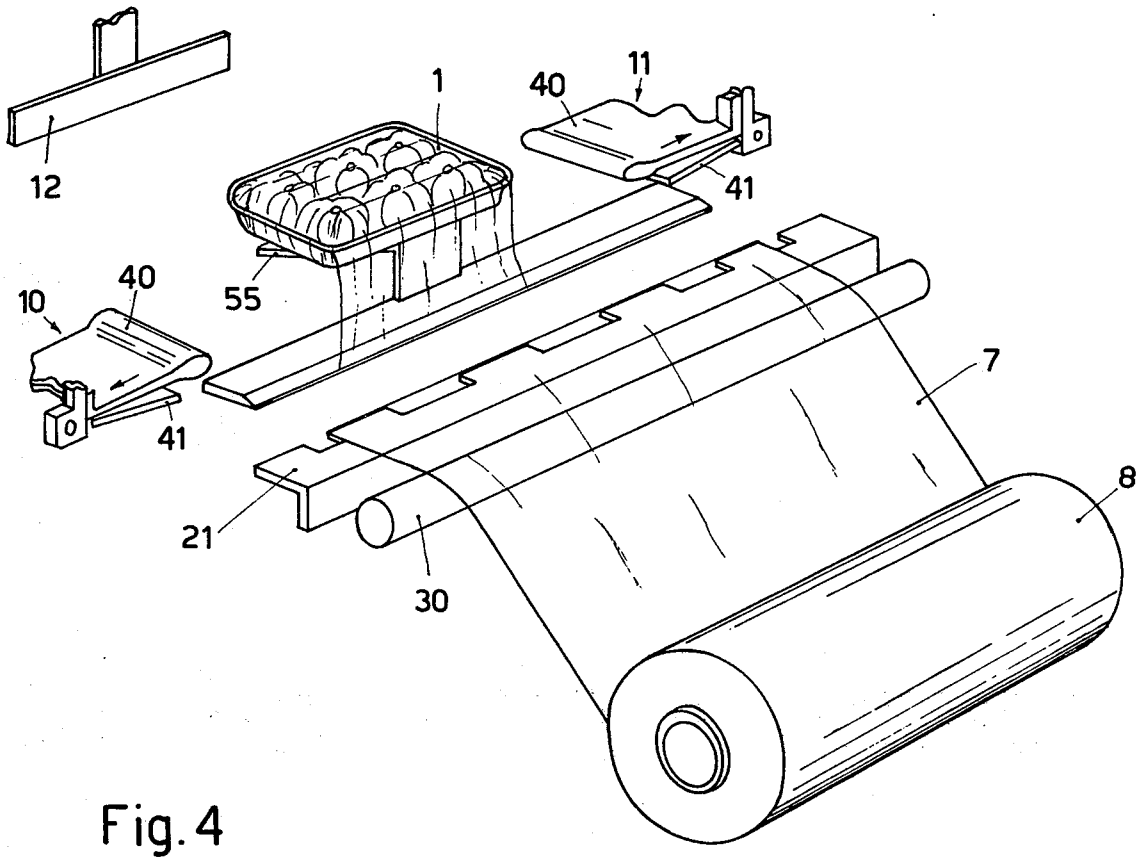
FIG. 4 is a diagram perspective view of the machine of FIG. 1, at an operating stage of its working cycle, subsequent to the stage shown in FIG. 3.

The lifting of plate 2 is synchronized by means of a cam shaft (not shown) with the backward stroke of clamps 10,11 toward each other and the opening of elements 51,53 of clamp 9, as well as of the outermost among clamping elements 19,20. Consequently, as shown in FIG. 3, the side opposed edges of the foil sheet are folded under tray 1, which is thus laterally wrapped without any further transversal stretching of the foil sheet, and at the end of the backward stroke of clamps 10,11 the edges are released, so that they can adhere against the underside of tray 1. Tray 1 is then supported by elements 40 so as to allow the lowering of the lifting plate 2 to its initial position and the approach of clamp 9. This latter (FIG. 3) still holds the foil sheet leading edge 7' in central position, by means of elements 52,54, whilst it is displaced toward tray 1. When the upper part 55 of clamp 9 is under tray 1, clamp 9 opens (FIG. 4) so that during this step of the wrapping process, the foil sheet leading edge 7' is folded, drawn under and caused to adhere against tray 1.

Figure 5:
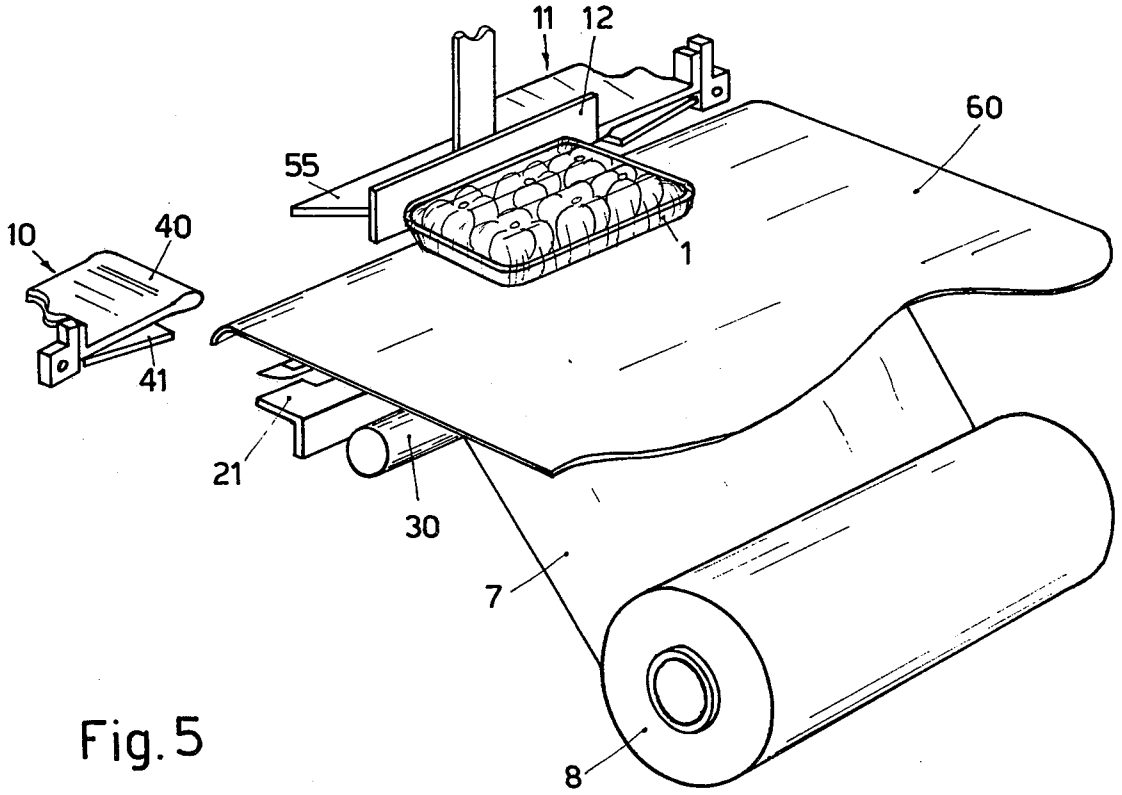
FIG. 5 perspectively shows a detail of the packaging machine in the final stage of its working cycle.

At this moment, tray 1 is supported by said element 55, and clamps 10,11 have come back to their initial position. In order to complete the wrapping of the last of the four tray sides, the foil sheet trailing edge 7'', so far kept by those clamping elements 19,20 which are centrally located with respect to the foil width, is released, whilst the thrusting element 12 displaces the tray from support element 55 to an output platform 60 placed as shown in FIG. 5 and not illustrated in the previous figures. When the wrapping of the product-containing tray 1 in the stretchable foil sheet is thus completed, one can proceed and weld the edges of said foil to the underside of the tray, by heating a suitable area of the output platform 60.

The synchronization of the strokes of clamps 10,11 and clamp 9, lifting table 2 as well as the opening and closing movements of said clamps, is achieved by means of a system of mechanisms and drive cams suitably connected to each other. These mechanisms and drive cams are not discussed herein in detail, as they are well known to those skilled in this art.

It is important to underline that the cam adjustment and profiles used in the machine according to this invention are suitable to control the perfect synchronism of the disclosed machine operation.

It will be noted that the packaging machine of this invention permits to accomplish not only the transversal stretching of the foil web 7 by means of the forward stroke of side clamps 10 and 11, but also the longitudinal stretching of foil. In fact during the forward stroke of clamps 10,11 a foil sheet is severed from foil web 7 by the blades 17,18 whilst it is restrained by the plurality of clamping elements 19,20. In this condition the foil sheet, after being transversally stretched, can undergo the longitudinal stretching under the action of the lifting table 2, which moves upwardly.

It should be noted, however, that according to the most preferred embodiment of this invention, the clamps consisting of the plurality of element 19,20 can be adjusted so as to block the foil web 7 before the end of the unreeling stroke of clamp 9, thus performing also the longitudinal maximum stretching of foil web 7. In this case it is obvious that during the vertical upward movement of lifting plate 2, not only the transversally opposed foil edges shall be released so as to avoid that the pre-fixed transversal maximum stretching is exceeded, but also the leading and trailing edge of the foil sheet shall be no longer held fast in order not to exceed the pre-fixed longitudinal maximum stretching either.

It should be noted that in order to achieve a proper treatment of foil web 7, both the peculiar construction of clamp 9 and that of the clamping devices consisting of couples of elements 19,20 are of remarkable importance. In fact, clamp 9 consisting of three gripping elements whose whole length is essentially equal to the foil web width, permits the uniform unreeling of foil 7 off the storage roll 8, without local stresses being brought about (because during the unreeling step the three elements 51,52,53 are closed against the lower element 54). It also permits the side folding of the foil under the action of clamps 10,11 without undesired stresses being brought about, since during this folding step clamps 51,53 are inoperative as they have been opened already at the end on the unreeling stroke of clamp 9 (for instance by means of a conventional lever-type mechanism).

Obviously the machine according to this invention can comprise other machine members, such as one or more sliding rolls 30 (FIGS. 1,2,3,4 and 5) and conventional devices which are not described as they are well known to any worker having ordinary skill in the technical field to which this invention pertains.

It is furthermore apparent that changes and/or modifications can be made to the disclosed machine and process without departing from the spirit and the scope of this invention.

What I claim is:

1. A process for wrapping and packaging a tray-like receptacle containing a generally irregularly shaped article in a foil sheet of stretchable plastic material, which receptacle has a flat bottom shallowly recessed from a low, outwardly-curved rim, said process comprising the steps of:

a. positioning said receptacle on a support at a wrapping location;

b. unreeling a section of a continuous foil web from a storage roll under evenly distributed tensile stress by gripping the leading edge of said foil and translating the foil section to said wrapping location in a direction normal to the leading edge proximate said supported receptacle;

c. stretching said foil section by a predetermined amount in at least the dimension transverse to the unreeling direction from locations at opposite sides of said supported receptacle;

d. longitudinally holding fast the transversely stretched foil section while severing said section from said storage roll to form a sheet from said foil section;

e. bringing said article-containing receptacle into contact with the stretched foil sheet while folding the longitudinally extending edges of the transversely stretched sheet over said rim and onto the bottom surface of said receptacle and simultaneously reducing the transverse tension effected by said stretching in order to maintain the predetermined amount of stretching in said foil;

f. folding the leading and trailing edges of said foil sheet over said rim and onto said bottom surface of said receptacle; and g. welding said leading, trailing and longitudinally extending edges to said bottom surface.

2. The process according to claim 1 wherein step (c) includes clamping said longitudinally extending edges in a state of transverse tension with said foil section oriented substantially horizontal above said supported receptacle;

wherein step (e) includes vertically elevating said article-containing receptacle from beneath said sheet to bring said receptacle into contact with said sheet while simultaneously reducing the transverse tension between said longitudinally extending side edges.

3. The process according to claim 1 wherein step (c) further comprises stretching said foil section in its longitudinal dimension.

4. The process according to claim 3 wherein the longitudinal stretching of said foil section comprises transversely blocking the unreeling of said foil web at a location upstream of the leading edge of said section while continuing to draw said leading edge in an unreeling direction.

5. The process of claim 1, wherein said stretching causes an increase of from about 22 to about 30 percent of the initial dimensions of said foil web.

6. A machine for wrapping and packaging items in sheets of stretchable plastic foil delivered from a storage roll of said material, said machine comprising:

a vertically movable lifting plate for supporting an item to be wrapped;

operable unreeling means, translatable over a predetermined distance in the delivery direction of said foil, for gripping a transversely extending leading edge of said foil, and selectively unreeling a section of said foil from said storage roll in a downstream to a location above said lifting plate by translating said leading edge over said predetermined distance;

a pair of opposed movable clamping means disposed symmetrically along opposite sides of said section of unreeled foil and along opposite sides of said lifting plate for gripping and transversely stretching said section by a predetermined amount;

actuable cutting means located downstream of said storage roll and upstream of said opposed clamping means for transversely severing said foil section from said storage roll;

actuable braking means disposed downstream of said cutting means and upstream of said opposed clamping means for selectively blocking unreeling of said foil from said storage roll by securing said foil in place;

support means integral with said unreeling means;

a movable thrusting member;

an unloading platform;

synchronized drive means, including a drive motor, a drive shaft connected to said motor, and a plurality of cams supported on said drive shaft and conventionally coupled to said unreeling means, said opposed clamping means, said thrusting member, said lifting plate, and said braking means for sequentially: operating said unreeling means; actuating said opposed clamping means to stretch said section by said predetermined amount; actuating said braking means; actuating said cutting means to sever said section from said storage roll; raising said lifting plate with an item to be wrapped supported thereon while gradually releasing the grip by said opposed clamping means to prevent further stretching of said section as said item contacts said section and simultaneously moving said opposed clamping means to a location below the raised item to be wrapped to fold the sides of said foil section under said item; moving said unreeling means to transfer said item onto said support means while folding the leading edge of said foil section under said item; and moving said thrusting member to push said item onto said unloading platform.

7. The machine of claim 6, wherein said unreeling comprises three basic clamps resulting from the combination in the form of an elastic hinge of an extended lower plate with three rectangular upper plates, the two outermost upper plates interacting with a limit stop-release lever, the lower plate being downwardly openable.

* * * * *